US009974399B1

(12) United States Patent
Tanger et al.

(10) Patent No.: US 9,974,399 B1
(45) Date of Patent: May 22, 2018

(54) ART BOARD HANGING APPARATUS

(71) Applicants: Jonathan P Tanger, Plantation, FL (US); Davina C Lochan, Plantation, FL (US)

(72) Inventors: Jonathan P Tanger, Plantation, FL (US); Davina C Lochan, Plantation, FL (US)

( * ) Notice: Subject to any disclaimer, the term of this patent is extended or adjusted under 35 U.S.C. 154(b) by 98 days.

(21) Appl. No.: 15/166,056

(22) Filed: May 26, 2016

(51) Int. Cl.

| | |
|---|---|
| ***A47G 1/16*** | (2006.01) |
| ***A47G 1/24*** | (2006.01) |
| ***A47B 96/06*** | (2006.01) |
| *B65D 23/00* | (2006.01) |
| *A47B 96/02* | (2006.01) |

(52) U.S. Cl.
CPC ..... *A47G 1/1606* (2013.01); *A47B 96/024* (2013.01); *A47B 96/066* (2013.01); *B65D 23/003* (2013.01)

(58) Field of Classification Search
CPC .. A47G 1/1606; A47B 96/066; A47B 96/024; B65D 23/003
USPC .. 248/475.1, 477, 489, 220.21, 220.31, 214, 248/490, 496, 317
See application file for complete search history.

(56) References Cited

U.S. PATENT DOCUMENTS

| | | | | |
|---|---|---|---|---|
| 4,283,038 | A * | 8/1981 | Kurtz | A47G 1/215 248/316.4 |
| 4,561,615 | A * | 12/1985 | Medlin, Jr. | H02G 3/125 220/3.5 |
| 5,433,416 | A * | 7/1995 | Johnson | B65D 23/003 248/475.1 |
| 7,708,252 | B2 * | 5/2010 | Vander Berg | A47B 96/027 248/475.1 |
| 8,720,915 | B2 * | 5/2014 | Diaz | A61H 3/04 280/87.021 |
| 2007/0023595 | A1 * | 2/2007 | Harmsen | A47G 1/1606 248/227.2 |

* cited by examiner

*Primary Examiner* — Tan Le
(74) *Attorney, Agent, or Firm* — Gulf Coast Intellectual Property Group

(57) ABSTRACT

A hanging apparatus operable suspend a wallboard on a surface of a wall wherein the hanging apparatus facilitates rotational positioning of the art board subsequent mounting. The hanging apparatus includes a wall support member wherein the wall support member includes a first portion planar in manner having an aperture. The wall support member includes a second portion contiguous to the first portion and angular thereto. An upper ledge extends outward from the second portion and is perpendicular to the first portion. A lower portion and leg member are additionally integrally formed to the first portion opposite the second portion. A frame support member is included having a body planar in manner and an aperture configured to receive the wall support member. The aperture has a perimeter edge with a lip member integrally formed therewith that is configured to engage the upper ledge and second portion of the wall support member.

3 Claims, 3 Drawing Sheets

ART BOARD HANGING APPARATUS

FIELD OF THE INVENTION

The present invention relates generally to hanging apparatus, more specifically but not by way of limitation, an art board hanging apparatus that is configured to suspend a thin art board or other similar structure to a vertical wall.

BACKGROUND

Artwork is displayed on numerous types of mediums which are known in the art such as but not limited to framed canvases and the like. The aforementioned types of art display mediums are suspended on a wall using various known types of hangers such as but not limited to strap hangers. One type of art display medium that is very common is an art board. As is known in the art, art boards are typically very thin most being only ⅛ inch in thickness. The thickness of the conventional art board creates a challenge when attempting to suspend the art board on a vertical wall. Conventional hangers such as but not limited to d-ring hangers and strap hangers do not work as the art board does not have a sufficient width to have the aforementioned fasteners secured thereto using mechanical techniques.

It is common for individuals to devise their own hanging technique for suspending art boards on a vertical wall. Techniques utilized range from chemical adhesion of wood blocks or chemical adhesion of other conventional mechanical fasteners. While these techniques have worked to some degree, the aforementioned techniques are limited in the altering of the orientation of the art board. Further, the use of the aforementioned techniques create an undesirable angular orientation between the art board and the wall to which the art board is suspended.

Accordingly, there is a need for an art board hanging apparatus that is configured to provide effective hanging of an art board wherein the art board is substantially parallel with the wall to which it is mounted. Furthermore, the art board hanging apparatus is configured to provide the ability for rotational positioning of the art board subsequent being mounted to a wall.

SUMMARY OF THE INVENTION

It is the object of the present invention to provide an art board hanging apparatus configured to suspend an art board on a wall surface that includes a wall support member that is configured to be secured to a wall surface.

Another object of the present invention is to provide a hanging apparatus configured to suspend an art board on a vertical wall surface that further includes a frame support member wherein the frame support member is secured to the rear surface of an art board.

A further object of the present invention is to provide an art board hanging apparatus configured to suspend an art board on a wall surface that includes suspension member that is surroundably secured to the frame member of the present invention and secured to the rear surface of an art board.

Still another object of the present invention is to provide an art board hanging apparatus wherein the wall support member includes a first mounting portion having an aperture configured to facilitate a fastener therethrough so as to secure the wall support member to a wall surface.

An additional object of the present invention is to provide an art board hanging apparatus configured to hang an art board on a vertical wall wherein the frame support member includes an aperture centrally disposed.

Yet a further object of the present invention is to provide an art board hanging apparatus configured to suspend an art board on a wall surface wherein the aperture of the frame member includes a perimeter edge that is configured with an angular mounting lip.

Another object of the present invention is to provide an art board hanging apparatus wherein the perimeter edge of the aperture of the frame member is configured to allow rotational positioning of the art board subsequent being mounted to a wall surface.

An alternative object of the present invention is to provide an art board hanging apparatus wherein the wall support member further includes an upper ledge configured to engage a portion of the perimeter edge of the frame support member.

Yet a further object of the present invention is to provide an art board hanging apparatus that is configured to suspend an art board on a vertical wall surface that is configured to eliminate any rocking movement of an art board ensuing the mounting thereof.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
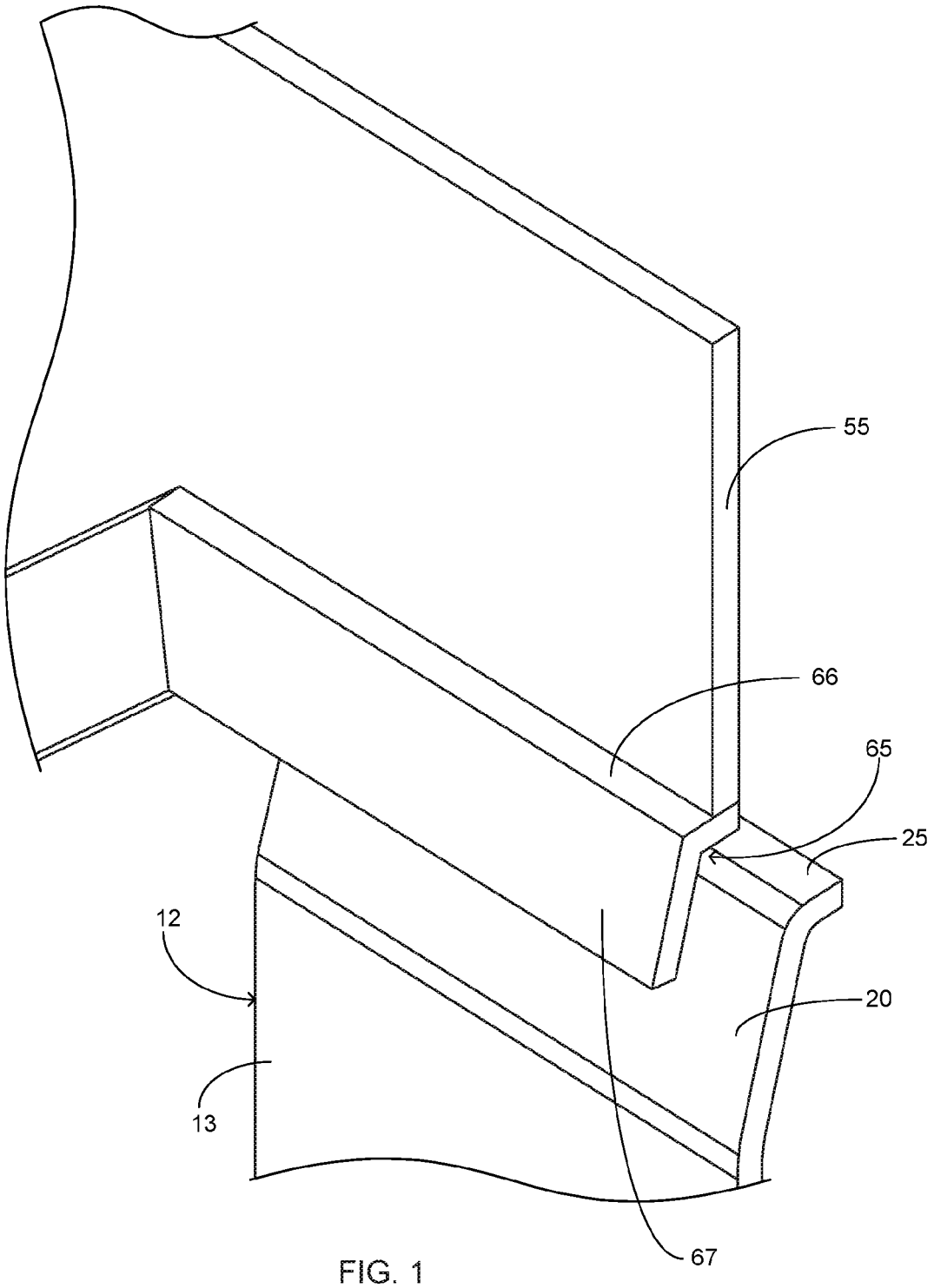
FIG. 1 is a detailed view of the frame support member engaged with the wall support member.

Referring now to the drawings submitted herewith, wherein various elements depicted therein are not necessarily drawn to scale and wherein through the views and figures like elements are referenced with identical reference numerals, there is illustrated an art board hanging apparatus 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic. For purposes herein, the term art board is contemplated to be broad covering any and all media suitable for displaying art or being adorned therewith or applied thereto wherein the media has two opposite surfaces.

Figure 2:
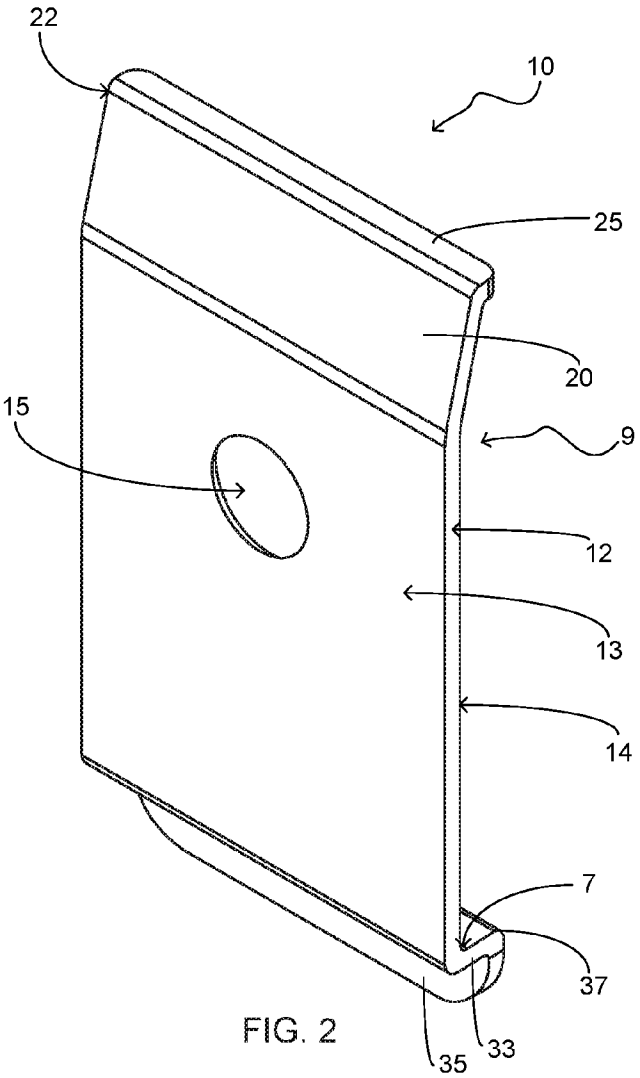
FIG. 2 is a perspective view of the wall support member of the present invention.

Referring in particular to FIG. 2 herein, the art board hanging apparatus 100 includes a wall support member 10. The wall support member 10 is manufactured from a suitable durable rigid material such as but not limited to plastic or metal. The wall support member 10 includes first portion 12 that is planar in manner having a first side 13 and second side 14. The first portion 12 is configured so as to be adjacent and parallel with a wall subsequent the wall support member 10 being secured thereto. The first portion 12 includes an aperture 15 journaled therethrough. The aperture 15 is annular in shape and is operable to receive a conventional fastener such as but not limited to a screw therethrough. Those skilled in the art should recognize that the aperture 15 could be formed in various shapes and sizes. Contiguously formed with the first portion 12 proximate end 9 in second portion 20. Second portion 20 is contiguous with first portion 12 and is formed such that the second portion 20 is angular with respect to the first portion 12. The second portion 20 is formed at an angle that directs the second portion 20 away from the first side 13 of the first portion 12. The first side 13 of the first portion 12 is adjacent a wall subsequent the wall support member being secured thereto. The second portion 20 is angular in manner so as to extend away from a wall to which the wall support member 10 is mounted.

Contiguously formed with the second portion 20 distal to end 9 is upper ledge 25. Upper ledge 25 is formed with the second portion 20 utilizing conventional techniques and is formed such that the upper ledge 25 forms a complementary angle with second portion 20 and is perpendicular to first portion 12. As further discussed herein the upper ledge 25 is configured to engage a portion of the frame support member 50 and effectively eliminate an angular forces therebetween. It is contemplated within the scope of the present invention that the upper ledge 25 could extend perpendicularly outward from the second portion 20 in a variety of lengths. Proximate end 7 a lower portion 33 is present. The lower portion 33 is contiguously formed with the first portion 12 and extends perpendicular therefrom in the same direction as the second portion 20 such that the lower portion 33 extends away from the first side 13. Contiguously formed with the lower portion 33 is lower leg member 35. Lower leg member 35 is contiguously formed with lower portion 33 distal to first portion 12. The lower leg member 35 extends downward from the lower portion 33 and is perpendicular thereto. The lower portion 33 and lower leg member 35 act in conjunction to ensure an art board being mounted with the art board hanging apparatus 100 is substantially parallel to the wall. The lower portion 33 extends away from the first portion 12 an equivalent distance such that the upper ledge 25 and end 37 are parallel which provides the aforementioned functionality of maintaining an art board suspended with the art board hanging apparatus 100 in a parallel manner with respect to a wall.

Figure 3:
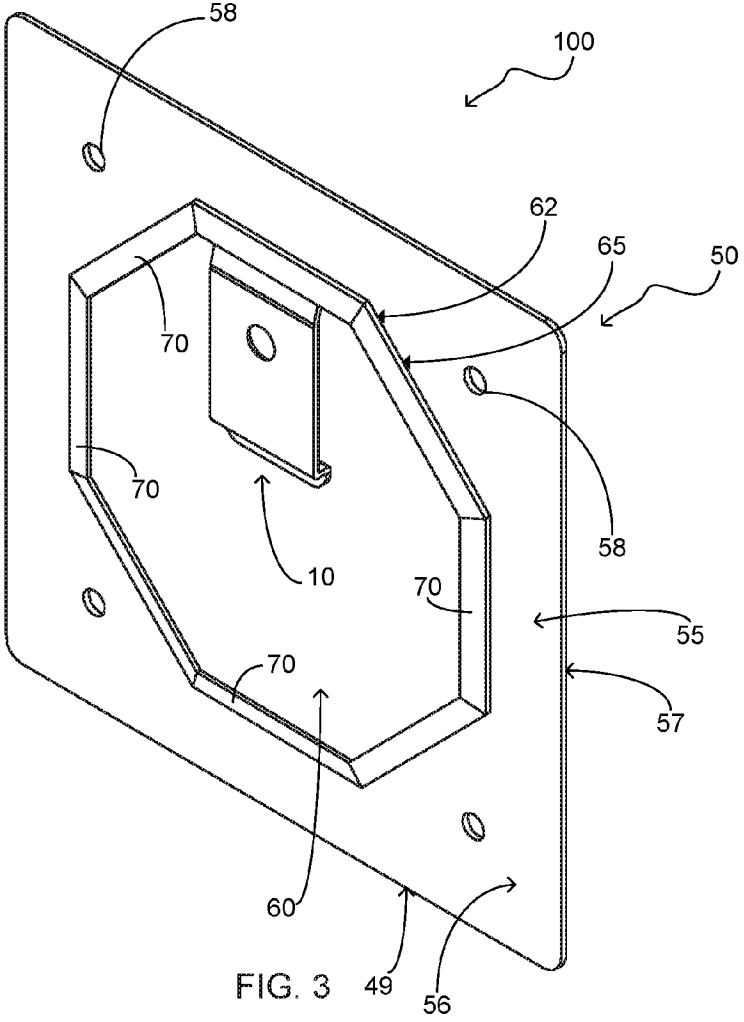
FIG. 3 is a perspective view of the wall support member and the frame support member of the present invention.

Referring to FIG. 2 and FIG. 3 herein, the frame support member 50 is illustrated therein. The frame support member 50 includes a body 55 that is planar in manner and manufactured from a suitable rigid material such as but not limited to plastic or metal. The body 55 is square in shape having a first side 56 and a second side 57. While the body 55 is illustrated herein as being square in shape, it is contemplated within the scope of the present invention that the body 55 could be formed in alternate shapes. The body 55 includes a plurality of holes 58. The plurality of holes 58 are evenly dispersed on body 55 and are operable to receive a mechanical fastener, such as but not limited to a screw, therethrough in order to secure the frame support member 50 to art media such as but not limited to wood, plaques and other suitable media. It is contemplated within the scope of the present invention that the body 55 could have any number of holes 58 in order to achieve the desired objective discussed herein. The body 55 has aperture 60 formed therethrough. Aperture 60 is formed having a size so as to be sufficient to accommodate wall support member 10 therein as illustrated in FIG. 3 herein. Aperture 60 includes perimeter edge 62 having lip member 65 contiguously formed therewith. Lip member 65 includes first section 66 and second section 67. First section 66 is integrally formed with body 55 utilizing suitable techniques and is perpendicular to body 55 extending away from an art board subsequent being mounted thereto. Second section 67 is integrally formed with the first section 66 and is angular in orientation with respect thereto wherein the second section 67 angles away from body 55. As shown in particular in FIG. 1 herein, the first section 66 is configured so as to superpose upper ledge 25 and the second section 67 is adjacent the second portion 20. The upper ledge 25 engagement with the first section 66 further ensures no angular force being applied to the frame member 50 ensuing the frame member 50 being coupled to the wall member 10. The second portion 20 and second section 67 have corresponding angles so as to facilitate the aforementioned desired position. The lip member 65 functions to mateably engage the portions of the wall member 10 as described and illustrated herein so as to provide effective suspension of a conventional art board coupled to the wall member 10 of the art board hanging apparatus 100. The lip member 65 comprises a plurality of segments 70 that are contiguously formed so as to extend circumferentially along the perimeter edge 62 of aperture 60. In the embodiment illustrated herein the aperture 60 is octagonal in shape thereby having eight segments 70. The octagonal shape of the aperture 60 allows an art board being suspended by the art board hanging apparatus 100 to be rotated in eight discrete movements for desired positioning. While the aperture 60 is illustrated herein as being octagonal in shape, it is contemplated within the scope of the present invention that the aperture 60 could be formed in numerous shapes. By way of example but not limitation, the aperture 60 could be a circle thereby having a single contiguous lip member 65 or have a shape that has greater then eight segments 70.

Figure 4:
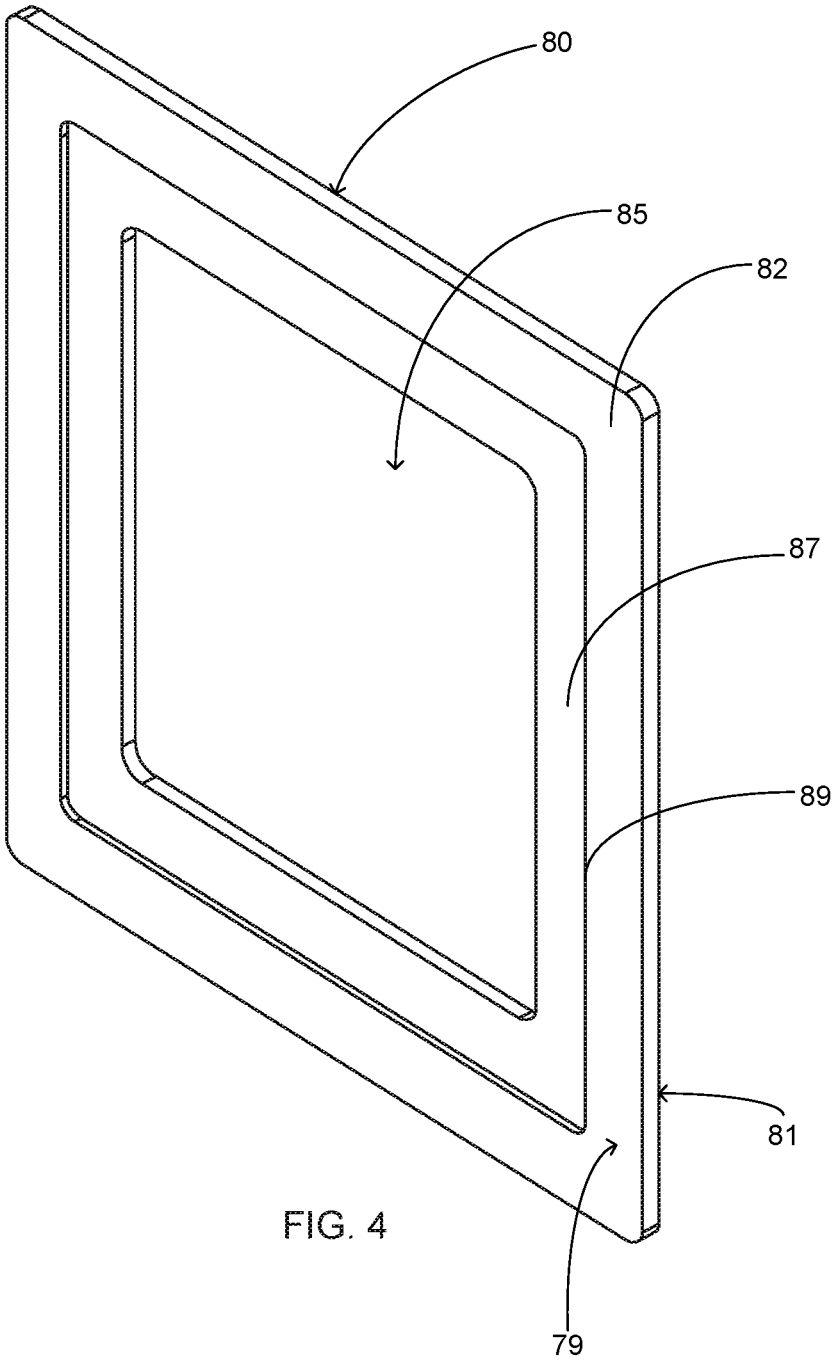
FIG. 4 is a perspective view of the suspension member of the present invention.

Illustrated in FIG. 4 herein is the suspension member 80. The suspension member 80 is configured to mateably engage with the frame member 50. Suspension member 50 is designed to be utilized when a heavier article is to be hung using the art board hanging apparatus 100. The suspension member 80 includes body 82 having aperture 85. The body 82 includes recessed ledge 87 that is mateably shaped so as to receive the body 55 of the frame member 50. As shown herein, edge 89 is square in shape so as to mateably engage edge 49. The body 82 includes first side 81 and second side 79 and wherein second side 79 is configured to be secured to a rear side of an article being hung with the art board hanging apparatus 100 using suitable durable chemical adhesion. Ensuing securing the suspension member 80 to an article the body 55 of the frame member 50 is placed within the recessed ledge 87. It is contemplated within the scope of the present invention that the recess ledge 87 could be formed in various shapes so as to mateably engage with a body 55 having alternate shapes of the outer perimeter edge 49.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A hanging apparatus configured to suspend an art board on a wall comprising:

a wall support member, said wall support member having a first portion, said first portion being planar in manner, said first portion having a first side and a second side, said first side configured to be adjacent a wall ensuing said wall support member being secured thereto, said first portion having an aperture, said first portion having a first end and a second end, said wall member having a second portion, said wall support member further including a lower portion, said lower portion integrally formed with said first portion opposite said second portion, said lower portion being perpendicular to said first portion, said second portion being contiguous with said first portion proximate said first end, said second portion being angular in manner with respect to said first portion, said wall support member further including an upper ledge, said upper ledge being contiguous with said second portion opposite said first portion, said upper ledge being perpendicular to said first portion, said wall support member being configured to be secured to a surface of a wall utilizing a conventional mechanical fastener journaled through said aperture, said wall support member further including a lower leg member, said lower leg member contiguously formed with said lower portion and extending downward therefrom, said lower leg member configured to engage an inner surface of an art board so as to maintain the art board being hung with the hanging apparatus parallel to the wall;

a frame support member, said frame support member having a body, said body being planar in manner, said body having a first side and a second side, said first side being operable to be secured to an art board, said body having an aperture journaled therethrough, said aperture being of sufficient size so as to accommodate said wall support member, said aperture having a perimeter edge, said perimeter edge having a lip member integrally formed therewith, said lip member configured to engage said upper ledge and said second portion of said wall support member, wherein said lip member further includes a first section, said first section of said lip member being perpendicular to said body of said frame support member and further being configured to extend away from an art board secured to said frame support member, said lip member further including a second section, said second section being contiguously formed with said first section opposite said body, said second section being angular in manner with respect to said first section and wherein said first section of said lip member is configured to be superposed said upper ledge of said wall support member and said second section of said lip member is adjacent said second portion of said wall support member subsequent said frame support member being coupled to said wall support member;

a suspension member, said suspension member being secured to an art board, said suspension member configured to have said frame support member secured thereto; and wherein said frame support member is configured to be releasably secured to said wall support member so as to suspend the art board on a wall.

2. An art board hanging apparatus that is operable to suspend an art board to a wall and further allow rotational positioning thereof comprising:

a wall support member, said wall support member having a first portion, said first portion being planar in manner, said first portion having a first side and a second side, said first side configured to be adjacent a wall ensuing said wall support member being secured thereto, said first portion having an aperture, said first portion having a first end and a second end, said wall member having a second portion, said second portion being contiguous with said first portion proximate said first end, said second portion being angular in manner with respect to said first portion, said wall support member further including an upper ledge, said upper ledge being contiguous with said second portion opposite said first portion, said upper ledge being perpendicular to said first portion, said wall support member being configured to be secured to a surface of a wall utilizing a conventional mechanical fastener journaled through said aperture, wherein said wall support member further includes a lower leg member, said lower leg member contiguously formed with said lower portion and extending downward therefrom, said lower leg member configured to engage an inner surface of an art board so as to maintain the art board being hung with the hanging apparatus parallel to the wall;

a frame support member, said frame support member having a body, said body being planar in manner, said body having a first side and a second side, said first side being operable to be secured to an art board, said body having an aperture journaled therethrough, said aperture being of sufficient size so as to accommodate said wall support member, said aperture having a perimeter edge, said perimeter edge having a lip member integrally formed therewith, said lip member further including a first section, said first section of said lip member being perpendicular to said body of said frame support member and further being configured to extend away from an art board secured to said frame support member, said first section of said lip member configured to engage said upper ledge, said lip member further including a second section, said second section being contiguously formed with said first section opposite said body, said second section being angular in manner with respect to said first section, said second section configured to be adjacent and superposed said second portion of said wall support member;

a suspension member, said suspension member being secured to the art board, said suspension member having an aperture, said suspension member having a recessed ledge circumferentially disposed around said aperture, said suspension member configured to have said frame support member secured thereto; and wherein said frame support member is configured to be releasably secured to said wall support member so as to suspend the art board on a wall and wherein said upper ledge is operable to engage said first section of said lip member so as to substantially eliminate angular forces intermediate said wall support member and said frame support member.

3. The art board hanging apparatus as recited in claim 2, wherein said body of said frame member further includes a plurality of holes.

* * * * *